United States Patent [19]

McGovern et al.

[11] 4,395,325

[45] Jul. 26, 1983

[54] REDUCING SULFUR TRIOXIDE CONCENTRATION IN REGENERATION ZONE FLUE GAS

[75] Inventors: Stephen J. McGovern, Deptford; Peter J. Owens, West Deptford; Michael J. Dolan, Laurel Springs, all of N.J.

[73] Assignee: Mobil Oil Corporation, New York, N.Y.

[21] Appl. No.: 298,404

[22] Filed: Sep. 1, 1981

[51] Int. Cl.[3] ..... C10G 11/18; B01J 37/14

[52] U.S. Cl. ..... 208/113; 208/DIG. 1; 252/411 S; 252/417; 252/419

[58] Field of Search ..... 208/113, DIG. 1; 252/411 S, 417, 419

[56] References Cited

U.S. PATENT DOCUMENTS

| | | | |
|---|---|---|---|
| 4,153,535 | 5/1979 | Vasalos et al. | 252/411 S |
| 4,235,704 | 11/1981 | Luckenbach | 208/113 |
| 4,252,636 | 2/1981 | Mooi | 208/120 |
| 4,274,942 | 6/1981 | Bartholic et al. | 208/113 |
| 4,282,084 | 8/1981 | Gross et al. | 208/113 |

FOREIGN PATENT DOCUMENTS

| | | | |
|---|---|---|---|
| 1439532 | 6/1976 | United Kingdom | 252/417 |

OTHER PUBLICATIONS

McArthur et al.; *Oil & Gas Journal*; "Catalytic Control of FCC $SO_x$ Emission Looking Good;" Feb. 23, 1981, pp. 55–59.

*Primary Examiner*—Delbert E. Gantz
*Assistant Examiner*—O. Chaudhuri
*Attorney, Agent, or Firm*—Michael G. Gilman; Charles J. Speciale; Stanislaus Aksman

[57] ABSTRACT

Sulfur trioxide concentration in the flue gas of catalytic cracking regenerators is maintained at a predetermined level by controlling the flow rate of oxygen-containing regeneration gas into the regenerator, and, optionally, the amount of carbon monoxide combustion promoter in the regenerator.

9 Claims, 1 Drawing Figure

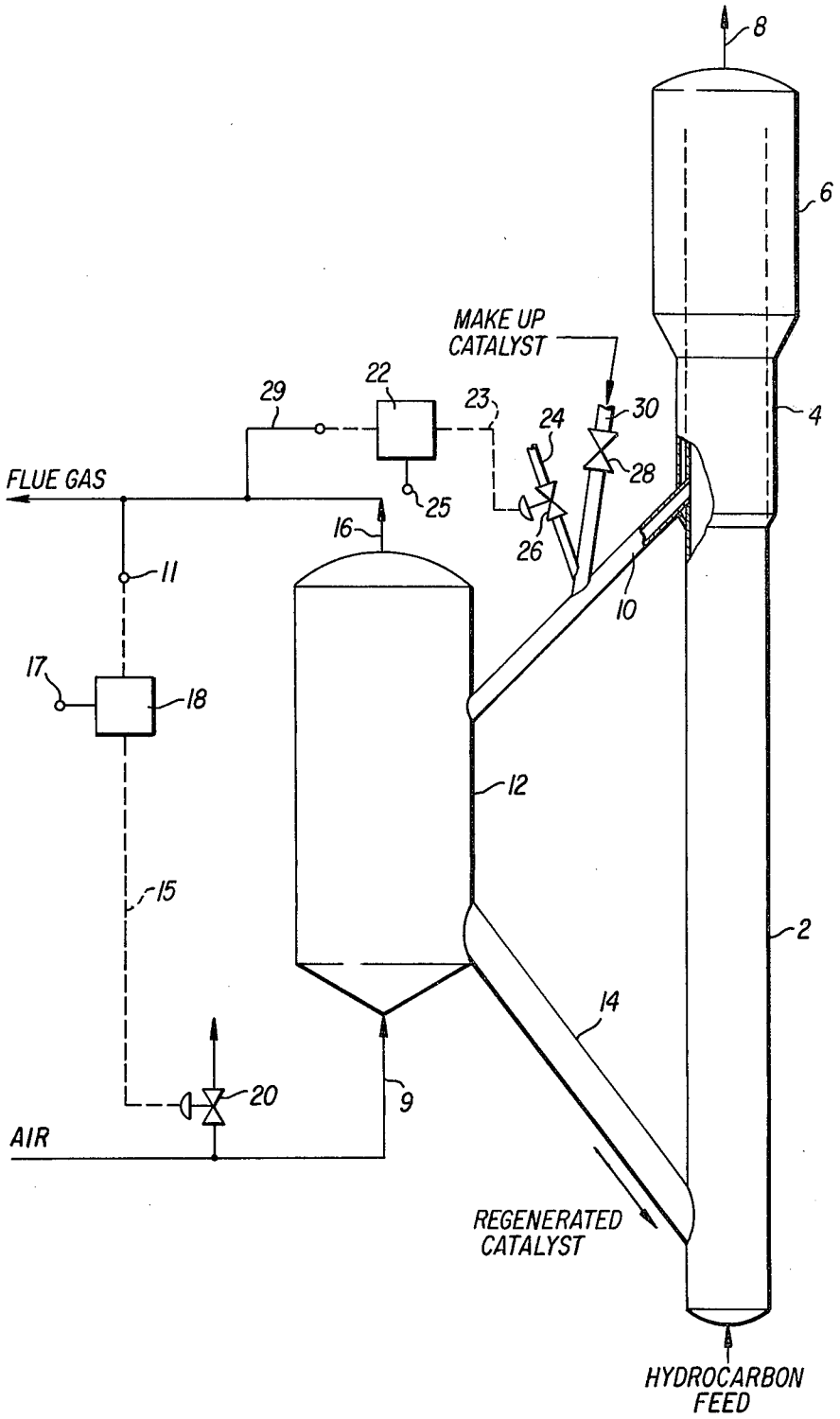
8
6
MAKE UP
CATALYST
22
29
23
24
30
4
28
FLUE GAS
25
16
26
11
10
17
18
12
15
2
14
20
9
AIR
REGENERATED
CATALYST
HYDROCARBON
FEED

REDUCING SULFUR TRIOXIDE CONCENTRATION IN REGENERATION ZONE FLUE GAS

BACKGROUND OF THE INVENTION

1. Field of the Invention

This invention relates to a method of reducing sulfur trioxide ($SO_3$) concentration in the exit flue gas from the regeneration zone of catalytic cracking units. More particularly, this invention relates to a method of maintaining the $SO_3/SO_x$ ratio in the exit flue gas at a predetermined level.

2. Description of the Prior Art

Environmental limitations imposed by state and federal regulatory agencies are becoming increasingly important considerations in the operation of catalytic cracking units (e.g., fluid catalytic cracking-FCC units). In many areas of the country, and even in some foreign countries, economic penalties, (e.g., reduced throughput, more expensive raw materials) are being paid for the excessively high levels of pollutants produced in the catalytic cracking operations. Most of the gaseous pollutants, formed in a catalytic cracking operation, are produced in the regenerator zone or vessel. For example, typical FCC unit comprises a reactor zone or vessel with a catalyst and a regenerator vessel wherein spent catalyst is regenerated. Feed is introduced into the reactor vessel and is converted therein over the catalyst. Simultaneously, coke forms on the catalyst and deactivates the same. The deactivated (spent) catalyst is removed from the reactor zone and is conducted to the regenerator zone wherein coke is burned off the catalyst with an oxygen-containing gas (e.g., air), thereby regenerating the catalyst. The regenerated catalyst is then recycled to the reactor vessel. Some of the catalyst is fractionated into fines and lost during the process because of constant abrasion and friction thereof against the various parts of the apparatus.

The efficiency of the regenerating operation is dependent on several operating parameters, the most important of which are regeneration temperature and oxygen availability. In recent years most operators have concentrated on rising regenerator temperature to increase the efficiency of the regenerator zone through a complete or almost complete combustion of carbon monoxide in the regenerator vessel. This is most commonly accomplished with the introduction of a carbon-monoxide combustion promoter usually comprising at least one of the following metals: platinum (Pt), palladium (Pd), rhodium (Rh), iridium (Ir), osmium (Os), and rhenium (Re). Some new regenerator designs have incorporated better mixing methods for mixing coke catalysts with platinum and oxygen (e.g., fast fluidized bed regenerator of Gross et al, U.S. Pat. No. 4,118,338, the entire contents of which are incorporated herein by reference). However, while these new methods of operation of the regenerating vessel decrease the amount of carbon monoxide exiting with the flue gas, and improve the overall efficiency of the regeneration process, they may sometimes contribute to an increased production of other pollutants, e.g., sulfur oxides, particularly sulfur trioxide ($SO_3$), and nitrogen oxides (see for example Luckenbach, U.S. Pat. No. 4,235,704).

Simultaneously with the improved methods of operation of a regeneration zone, which alone contribute to an increased production of sulfur oxides in the flue gases of the regenerator, sulfur feed levels in petroleum crudes available for cracking have been steadily increasing over the past few years. In the past, due to overall low levels of sulfur in FCC feeds, $SO_3$ levels in flue gases were low, and generally only total $SO_x$ levels were monitored without an $SO_2/SO_3$ breakdown or without regard to $SO_3$ levels. With the combination of the high sulfur feed levels and the high temperatures in the regeneration zone, the $SO_3$ concentration in the flue gas can be high enough to cause condensation in the flue gas which can result in a visible plume. Although all $SO_x$ emissions eventually turn to $SO_3$ in the atmosphere and fall to earth as acid rain, there are environmental reasons for preferring the emissions to be sulfur dioxide ($SO_2$), and the reaction of $SO_2$ to $SO_3$ to be carried out over an extended period of time. For example, high $SO_3$ concentrations resulting in a visible plume can fall to earth in a small area and cause more environmental damage than highly dispersed acid rain. In addition, various state and federal regulatory agencies presently set a maximum limit on the amount of $SO_3$, individually or as a function of the total $SO_x$ emissions being discharged from an industrial plant. (The term, total $SO_x$ emissions, as used herein means the sum total of the concentration of all sulfur oxides in a given gaseous stream.) Thus, restrictions are usually more stringent with respect to the sulfur trioxide emissions than they are for the sulfur dioxide emissions. For example, the state of New Jersey imposes a maximum of 2,000 parts per million (ppm) by volume for $SO_2$ emissions and 85 ppm by volume for the $SO_3$ emissions.

SUMMARY OF THE INVENTION

In accordance with the present invention, it has been found that the concentration of sulfur trioxide in the flue gas of the regeneration vessel can be maintained at a predetermined level by controlling the amount of the oxygen-containing regeneration gas in the regeneration vessel. Additionally, the amount of a carbon-monoxide combustion promoter in the regenerator may also be controlled, if necessary, to maintain the $SO_3$ concentration within the necessary limits. The amount of oxygen introduced to the regenerator is controlled by monitoring the oxygen concentration in the regenerator flue gas. The concentration of oxygen in the flue gas is maintained at about 0 to about 1 mole percent. The amount of the carbon monoxide combustion promoter is maintained at between about 0 and 2 ppm by weight of elemental metal based on the total weight of the catalyst. Control of one and/or both of these two operating parameters, within the aforementioned limits, enables operator of the process to maintain the $SO_3$ emissions at such a level that the ratio of $SO_3/SO_x$ is less than 5%.

BRIEF DESCRIPTION OF THE DRAWING

The FIGURE is a schematic flow diagram of the present process as applied to an exemplary fluidized catalytic cracking unit.

DETAILED DESCRIPTION OF THE INVENTION

The concentration of oxygen in the flue gas from the regeneration zone is monitored by any conventional means, such as a conventional in-line oxygen analyzer monitoring the concentration of oxygen in the flue gas exiting the regenerator. The data from the oxygen analyzer can then be relayed to the operator of the process, who would in turn manually adjust the amount of oxygen-containing gas flowing into the regenerator to maintain the oxygen level in the flue gas within the predetermined limits. Alternatively, the analyzer could be a part of a control loop connected to the feed line conducting oxygen-containing gas into the regenerator. The latter option is incorporated into one embodiment of the invention shown in the FIGURE and discussed in detail below. The amount of oxygen in the flue gas is maintained at between about 0 and about 1% by mole, preferably at less than 0.5% by mole. Some FCC feeds, e.g., atmospheric resids and vacuum heavy gas oils contain a substantial amount of metals, e.g., nickel (Ni) and vanadium (V), which may act, at concentrations of more than 1000 ppm of elemental metal per total catalyst weight, as carbon monoxide combustion promoters. When such feeds are used in the process, controlling the oxygen level in the regenerator in the aforementioned manner will usually be sufficient to maintain the $SO_3$ emissions at a predetermined level. However, added carbon monoxide combustion promoters, of the type specified above, i.e., Pt, Pd, Rh, Os, Ir and Re, are also often used even with feeds containing substantial proportions of V and Ni. If control of the amount of $O_2$ in the regenerator is not sufficient to maintain the $SO_3$ emissions at a predetermined level, it may also be necessary to control the amount of the added carbon monoxide combustion promoter to lower the $SO_3$ emissions.

Carbon monoxide combustion promoter is also normally added to FCC feeds containing very little, if any, nickel and vanadium, e.g., atmospheric heavy gas oils and vacuum light gas oils. In operating the FCC unit with such feeds, controlling the amount of oxygen in the regenerator may also not be sufficient to maintain $SO_3$ emissions at a predetermined level. In such cases it may also be necessary to control the carbon monoxide combustion promoter level in the regenerator to lower the $SO_3$ emissions.

The concentration of carbon monoxide promoter is controlled in a steady state operation by controlling the amount of the promoter added to the FCC installation with the makeup cracking catalyst to replace attrition losses and to replace promoter which has become poisoned. The level of the promoter in the makeup catalyst can be controlled, for example, manually to provide less than 2 ppm by weight of elemental metal based on the total weight of the catalyst in the regeneration vessel makeup catalyst stream. Alternatively, as shown in the embodiment of the FIGURE, and discussed in detail below, the control of the level of the promoter can be accomplished as a part of the control loop comprising an $SO_3$ in-line analyzer in the flue gas and a valve controlling the flow of the promoter to the makeup catalyst stream. For example, when the $SO_3$ sensor indicates that the $SO_3$ concentration in the exit flue gas exceeds a predetermined limit, the amount of the promoter added to the system would be decreased, or no promoter would be added at all. Yet another method of decreasing the combustion promoter concentration would be to remove the catalyst containing the combustion promoter from the cracking unit and replace it with a catalyst free of combustion promoter. This latter method is not preferred for economic reasons, namely because of the relatively large quantities of catalyst which would have to be removed from the system to effect a significant reduction in the concentration of combustion promoter within the system. Conversely, when the $SO_3$ concentration is well below the predetermined limit (that limit being such that the ratio of $SO_3/SO_x$ is less than 5 percent), additional combustion promoter may be added to facilitate the conversion of CO to $CO_2$. This would permit the amount of excess oxygen in the exit flue gas, as measured by the oxygen sensor, to be decreased by decreasing the regeneration gas intake, or, if the regeneration gas intake is maintained constant, this would permit an increase in the catalyst circulation rate to the regeneration zone. Increasing promoter activity may be accomplished in a variety of ways. Since the oxidation promoters are normally used in relatively low concentrations, they are frequently incorporated with conventional cracking catalysts into a concentrate to provide a more uniform distribution. Thus, the combustion promoter concentrate may be added directly. A catalyst containing a relatively high amount of combustion may be utilized as a makeup catalyst. Combustion promoter could also be dissolved in an easily volatilized solution and pumped into the system. Since the oxidation promoter adversely affects feedstock cracking products, the promoter is preferably added to the regeneration zone, rather than to the reaction zone.

In general, the process of this invention can be utilized with any conventionally-used catalytic cracking, feeds, such as napthas, gas oils, vacuum gas oil, residual oils, light and heavy distillates and synthetic oils. Similarly, the process can be used with any regenerator design, such as fast fluidized regenerators, as disclosed by Gross et al, U.S. Pat. No. 4,118,338.

Suitable catalysts are any conventional catalytic cracking catalysts, e.g., those containing silica and silica-alumina or mixtures thereof. Particularly useful are higher and lower activity zeolites, preferably low coke-producing crystalline zeolite cracking catalysts comprising faujasite, crystalline zeolites and other zeolites known in the art. The carbon monoxide burning promoter optionally used in the process is any conventionally used carbon monoxide burning promoter, such as platinum (Pt), palladium (Pd), rhodium (Rh), iridium (Ir), osmium (Os), and rhenium (Re). The amount of the carbon monoxide burning promoter in the process of this invention at less than 2 ppm by weight and preferably at 0.1–1 ppm by weight, based on the total weight of the catalyst to maintain the $SO_3/SO_x$ ratio at below 5%.

The regeneration procedure for the catalysts containing the promoter is preferably that particularly promoting the recovery of available heat generated by the burning of carbonaceous deposits produced in hydrocarbon conversion, such as that disclosed in U.S. Pat. Nos. 3,748,251 and 3,886,060, the entire contents of both of which patents are incorporated herein by reference.

The process of this invention can be used with any fluid catalytic cracking (FCC) process and apparatus. Similarly, the materials of construction conventionally used in the FCC installation can be used in any installations using the present process.

The invention will now be described in conjunction with one exemplary embodiment thereof illustrated in the FIGURE.

In reference to the FIGURE, a hydrocarbonaceous feed, is introduced at the bottom of the riser reactor 2. Hot regenerated catalyst is also introduced to the bottom of the riser by a standpipe 14, usually equipped with a flow control valve, not shown in the FIGURE for clarity. The feed volatilizes, almost instantaneously, and it forms a suspension with the catalyst which proceeds upwardly in the reactor. The suspension formed in the bottom section of the riser is passed through the riser under selected temperature and residence time conditions. The suspension then passes into a generally wider section of the reactor 6 which contains solid-vapor separation means, such as conventional cyclones, and means 4 for stripping entrained gases from the catalyst. The waste gases are withdrawn from the reactor by a conduit 8. Neither the stripping section, nor the solid-gas separation equipment is shown in the drawing for clarity. Such equipment is that conventionally used in catalytic cracking operations of this kind and its construction and operation will be apparent to those skilled in the art.

Stripped catalyst containing carbonaceous deposits (i.e., coke) is withdrawn from the bottom of the stripping section through a conduit 10 and conducted to a regeneration zone or vessel 12. In the regeneration zone the catalyst is regenerated by passing oxygen-containing gas, such as air, into the regeneration zone and burning the coke off the catalyst. Due to attrition losses, a portion of the catalyst must be replenished in a steady state operation. To this end, the conduit 10 has connected thereto a conduit 30 supplying makeup catalyst to the system.

The amount of oxygen in the flue gas withdrawn by a conduit 16 is measured by a composition sensor 11 which transmits a signal indicative of the oxygen concentration to the controller 18. Valve 20 may also be commonly controlled by operator intervention to control the rate of air flow and thus the CO and oxygen ($O_2$) content of the flue gas. Alternatively, however, the signal generated by composition sensor 11 is transmitted to the composition controller 18. Controller 18, equipped with a set point 17, places a signal on line 15, which signal is indicative of the deviation of the oxygen composition of the flue gas from a predetermined value of the set point 17 (0.0 to 1.0% by mole). A control valve 20 is in turn adjusted in a direction to reduce the deviation of the measured composition from the predetermined composition as defined by the set point 17. Accordingly, if the amount of oxygen in the flue gas exceeds the level predetermined and preset at the set point 17, the degree of opening of the valve 20 will increase, thereby also decreasing the amount of oxygen introduced into the regeneration zone through a conduit 9. Conversely, the degree of opening of the valve 20 will decrease, thereby increasing the amount of oxygen permitted to enter regeneration zone 12, if the amount of oxygen detected in the flue gas by the sensor 11 is below that preset at the set point 17.

If, as discussed above, control of the amount of oxygen in the regenerator is not sufficiently effective to maintain the $SO_3$ emissions at a predetermined level, it may also be necessary to control the carbon monoxide combustion promoter level in the regenerator. For this purpose, a conduit 24 connected to the conduit 10 supplies additional carbon monoxide combustion promoter to the system. The conduit 30, discussed above, is equipped with a conventional valve 28 which can be regulated manually or automatically in conjunction with a conventional control loop to adjust the amount of the makeup catalyst introduced into the system. The conduit 24 is also equipped with a flow control valve 26. In the FIGURE, the control valve is shown to be a part of a control loop comprising a composition sensor 29 which indicates the $SO_3$ concentration of the flue gas and generates a signal indicative of that concentration. Valve 26 may be controlled by operator intervention to control the flow of the carbon monoxide combustion promoter, and thus the carbon monoxide and oxygen content of the flue gas. Alternatively, the signal generated by the composition sensor 29 may be transmitted to the composition controller 22. Controller 22, equipped with a set point 25, places a signal on line 23, which is indicative of the deviation of the $SO_3$ composition of the flue gas from the set point 25 to adjust the control valve 26 in a direction to reduce the deviation of the measured composition from the predetermined composition as defined by set point 25. The set point 25 is set at such a value of $SO_3$ emissions that the ratio of $SO_3/SO_x$ in the flue gas is 5% or less. With the increase in the $SO_3$ concentration, the degree of opening of the valve 26 will be decreased and thus the amount of the fresh promoter introduced into the system also decreased. Conversely, if the $SO_3$ concentration in the flue gas is lower than the set point 25, the degree of opening of the valve 26 will be increased and the amount of carbon-monoxide burning promoter introduced into the system increased, thereby assuring a more complete combustion of carbon monoxide to carbon dioxide. The amount of the carbon monoxide combustion promoter is maintained at less than 2 ppm, preferably at 0.1–1 ppm, of elemental metal based on the total weight of the catalyst. The control of $O_2$ and, if necessary, of the amount of the combustion promoter in the regenerator is carried out to maintain the $SO_3$ emissions at such a level that the $SO_3/SO_x$ ratio is less than 5%.

It will be obvious to those skilled in the art that the two control functions, namely the control of $O_2$ in the flue gas, and optionally of the combustion promoter, may be combined, monitored and controlled by a single controller means. It will also be obvious to those skilled in the art that the catalytic cracking process and apparatus of this invention may conventionally be equipped with a number of other control loops normally used in catalytic cracking installations, and the operation of these conventional loops can be integrated with and/or can be kept independent of the operation of the control loops disclosed herein. Such conventionally used control loops, and other details of FCC processes, are fully disclosed in the following patents and publications: U.S. Pat. No. 2,383,636 (Wurth); 2,689,210 (Leffer); 3,338,821 (Moyer et al); 3,812,029 (Snyder, Jr.); 4,093,537 (Gross et al); 4,118,338 (Gross et al); Venuto et al, *Fluid Catalytic Cracking with Zeolite Catalyst*, Marcel Dekher, Inc. (1979); and in a copending U.S. application by Gross, Ser. No. 217,879 filed Dec. 18, 1980. The entire contents of all of these patents, applications and publications are incorporated herein by reference.

It will be apparent to those skilled in the art that the above example and general description of the process can be successfully repeated with apparatus and ingredients equivalent to those generically or specifically set forth above and under variable process conditions.

From the foregoing specification one skilled in the art can readily ascertain the essential features of this invention and without departing from the spirit and scope thereof, can adapt it to various diverse applications.

What is claimed is:

1. In a catalytic cracking process comprising:

contacting a hydrocarbonaceous feed with a cracking catalyst to produce cracked hydrocarbon vapors and deactivated catalyst containing carbonaceous deposits;

separating the deactivated catalyst from the hydrocarbon vapors and conducting the deactivated catalyst to a regeneration vessel;

at least partially removing the carbonaceous deposits from the deactivated catalyst in the regeneration vessel by means of an oxygen-containing gas introduced into the regeneration vessel, thereby forming a flue gas comprising oxygen, sulfur dioxide, sulfur trioxide, carbon monoxide and carbon dioxide;

the improvement which comprises monitoring the sulfur trioxide and the oxygen concentration in the flue gas from the regeneration vessel; and adjusting the amount of the oxygen-containing gas in the regeneration vessel in relation to the concentration of the sulfur trioxide to maintain the concentration by volume of the sulfur trioxide in the flue gas such that the ratio $SO_3/SO_x$ in the flue gas is less than 5%, thereby preventing the appearance of a visible condensation plume in the flue gas.

2. A process according to claim 1 wherein the cracking catalyst also contains a carbon monoxide combustion promoter.

3. A process according to claim 2 wherein the amount of the carbon monoxide combustion promoter is also adjusted to maintain the concentration by volume of the $SO_3$ in the flue gas such that the ratio $SO_3/SO_x$ in the flue gas is less than 5%, thereby preventing the appearance of a visible condensation plume in the flue gas.

4. A process according to claim 3 wherein the concentration of oxygen in the flue gas is about 0.0 to 1% by mole.

5. A process according to claim 4 wherein the carbon monoxide combustion promoter is selected from the group consisting of Pt, Pd, Rh, Ir, Os and Re.

6. A process according to claim 5 wherein the carbon monoxide combustion promoter is Pt.

7. A process according to claims 5 of 6 wherein the amount of the combustion promoter in the regeneration vessel is about 0 to about 2 parts per million by weight of elemental metal, based on the total weight of the catalyst.

8. A process according to claim 7 wherein the amount of the combustion promoter in the regeneration vessel is about 0.1 to about 1 parts per million by weight of elemental metal, based on the total weight of the catalyst.

9. A process according to claim 8 wherein the concentration of oxygen in the flue gas is less than 0.5% by mole.

* * * * *

UNITED STATES PATENT AND TRADEMARK OFFICE

CERTIFICATE OF CORRECTION

PATENT NO. : 4,395,325

DATED : July 26, 1983

INVENTOR(S) : Stephen J. McGovern and Peter J. Owens and Michael J. Dolan

It is certified that error appears in the above-identified patent and that said Letters Patent is hereby corrected as shown below:

Column 3, line 33, after "maintain" insert --the--.

Column 4, line 23, delete the comma "," after "cracking".

Signed and Sealed this

*Twenty-fourth* Day of *January 1984*

[SEAL]

*Attest:*

GERALD J. MOSSINGHOFF

*Attesting Officer*

*Commissioner of Patents and Trademarks*